US006074171A

United States Patent [19]

Giannantonio et al.

[11] Patent Number: 6,074,171

[45] Date of Patent: Jun. 13, 2000

[54] GETTER PUMP ESPECIALLY SUITABLE FOR THE USE UPSTREAM, IN PROXIMITY COAXIALLY WITH RESPECT TO A TURBOMOLECULAR PUMP

[75] Inventors: Roberto Giannantonio, Gallarate; Andrea Conte, Milan, both of Italy

[73] Assignee: Saes Getters S.p.A., Lainate, Italy

[21] Appl. No.: 09/234,546

[22] Filed: Jan. 21, 1999

Related U.S. Application Data

[63] Continuation of application No. PCT/IT98/00156, Jun. 11, 1998.

[30] Foreign Application Priority Data

Jun. 17, 1997 [IT] Italy ..... MI97A1420

[51] Int. Cl.[7] ..... F04B 37/02

[52] U.S. Cl. ..... 417/51; 417/48

[58] Field of Search ..... 417/48, 51

[56] References Cited

U.S. PATENT DOCUMENTS

| | | | |
|---|---|---|---|
| 3,662,522 | 5/1972 | Della Porta et al. . | |
| 4,137,012 | 1/1979 | Della Porta et al. . | |
| 5,483,803 | 1/1996 | Matté et al. . | |
| 5,935,395 | 8/1999 | Ouellet et al. | 204/298.07 |
| 5,972,183 | 10/1999 | Krueger et al. | 204/298.07 |
| 5,980,213 | 11/1999 | Krueger et al. | 417/51 |
| 5,993,165 | 11/1999 | Lorimer et al. | 417/51 |
| 5,997,255 | 12/1999 | Krueger et al. | 417/48 |

FOREIGN PATENT DOCUMENTS

| | | |
|---|---|---|
| 133697 | 1/1979 | Germany . |
| 02215977 | 8/1990 | Japan . |

*Primary Examiner*—Teresa Walberg
*Assistant Examiner*—Vinod D Patel
*Attorney, Agent, or Firm*—Akin, Gump, Strauss, Hauer & Feld, L.L.P.

[57] ABSTRACT

A getter pump, especially suitable for the use upstream, in proximity and coaxially with respect to a turbomolecular pump, comprising inside a cylindrical cartridge (10) a getter device (20) formed of a continuous coil-shaped metal wire having turns **(18, 18*a*) or formed of several zigzag-shaped segments mutually in series between two end points (22), such as to lie in an annular-shaped peripheral zone, concentric with respect to said cartridge (10) and coated with a sintered porous layer of non-evaporable getter material in form of powder. Said cartridge (10) is inserted into a steel stub (30) which is fastened on one side to the chamber to be evacuated and on the other side to a turbomolecular pump. The getter device (20) may be directly supplied with electric current from the outside through said ends (22)**.

7 Claims, 2 Drawing Sheets

Fig.1a
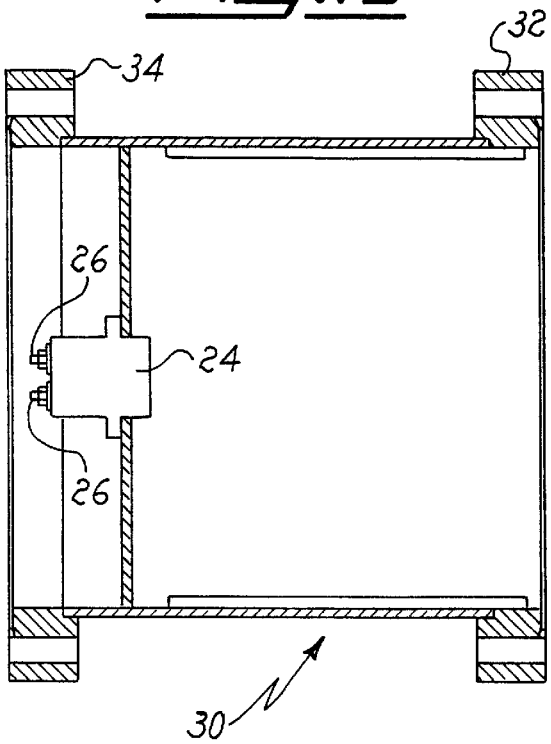
Fig.1b
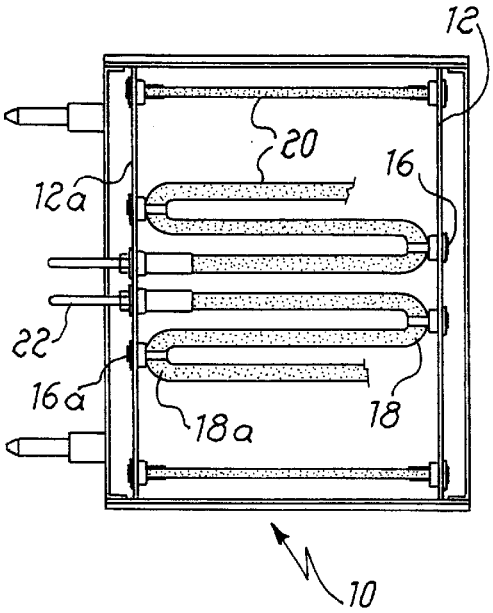
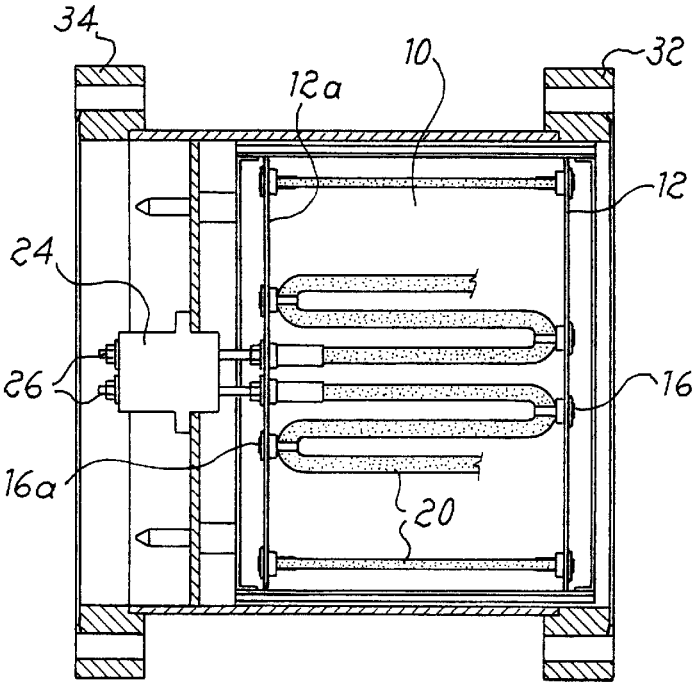
Fig.2

GETTER PUMP ESPECIALLY SUITABLE FOR THE USE UPSTREAM, IN PROXIMITY COAXIALLY WITH RESPECT TO A TURBOMOLECULAR PUMP

CROSS-REFERENCE TO RELATED APPLICATION

This application is a continuation of International Application PCT/IT98/00156, filed Jun. 11, 1998, the disclosure of which is incorporated herein by refernce.

BACKGROUND OF THE INVENTION

The present invention relates to a getter pump especially suitable for the use upstream, in proximity and coaxially with respect to a turbomolecular pump.

The getter pumps are static pumps, i.e. lack mechanical moving members, and their working is based on the chemisorption of reactive gases such as oxygen, hydrogen, water and carbon oxides by elements made of non-evaporable getter materials (known in the field as NEG materials). The main NEG materials are alloys based on zirconium or titanium.

The getter pumps for generating and keeping the high vacuum in an enclosed environment nearly always work combined with other pumps; in particular, the first high-pressure pumping stage is performed by mechanical pumps such as rotary or diffusion pumps, whereas getter pumps combined with chemical-ion, cryogenic or turbomolecular pumps may be used for attaining high vacuum.

It is especially advantageous to combine getter pumps with turbomolecular pumps. In fact, the efficiency of turbomolecular pumps decreases upon decreasing of the molecular weight of the gas and therefore their efficiency is low for hydrogen, which is one of the gases mainly contributing to the residual pressure in evacuated systems in the medium vacuum range and is the main residual gas at pressures lower than $10^{-9}$ hPa. On the other hand, the getter pumps are especially effective in pumping hydrogen, in particular for temperatures ranging from room temperature to about 300 ° C. Thus the combination of a getter pump and a turbomolecular pump, in that combining different behaviors with respect to the gases present in the system or anyhow to remove, is an optimal solution for the problem of evacuating a chamber. In particular, this combination is advantageous in case the chamber to be evacuated is a working chamber used for high-vacuum operations, such as e.g. a chamber of a process machine of the semi-conductor industry.

These advantages are in principle maximized when the two pumps are arranged in series, with the getter pump being upstream with respect to the turbomolecular pump. However, so far the two pumps have never been arranged in series, but have always been mounted through flanges onto two different openings of the chamber to be evacuated, in order to avoid the following problems and drawbacks:

- the getter elements forming the pump are generally produced by compacting NEG material powders; the getter pump is thus liable to loose particles possibly hitting the turbomolecular pump blades and damaging them, or causing the pump to grip by coming between its rotor and its stator;
- interposing a getter pump between the chamber to be evacuated and the turbomolecular pump generally results in a decrease of the gas conductance to this latter;
- when the getter pump is working, the non-evaporable getter material must be kept at temperatures of about 200–300° C.; for this purpose it was so far heated by irradiation from inside the pump by means of lamps or filament resistances wound upon a generally ceramic support, or from outside the pump by means of suitable heating members arranged on the pump body; thus, a rise of the turbomolecular pump temperature might also occur resulting in expansion of the blades beyond the tolerances (being moreover very small) acceptable for a good pump working. On the other hand, the increase of the distance between the pumps or the incorporation of thermal shields therebetween in order to reduce the effect of the rise of the turbomolecular pump temperature would result in an unacceptable reduction of the gas flow conductance.

Another drawback, however less important than those indicated above, was the fact that, by using the aforementioned heating systems, thermocouples had to be necessarily provided on the getter pump for measuring the temperature of the active material whereby complex tightness problems related to the wires having to come out from a vacuum-environment had to be solved.

SUMMARY OF THE INVENTION

It is an object of the present invention to overcome the aforementioned drawbacks by means of a getter pump arranged upstream, in proximity and coaxially with respect to a turbomolecular pump, in a structure connecting the chamber to be evacuated and the turbomolecular pump, such as to reduce the loss of particles, minimize the conductance reduction and minimize the indirect rise of temperature of the turbomolecular pump, thereby ensuring an improved pumping efficiency of the assembly.

Furthermore, the temperature of the getter pump may be measured according to the invention through direct resistance measurements from the outside of the pump, without having to use thermocouples or wires passing through the pump body, with high reproducibility properties.

BRIEF DESCRIPTION OF THE SEVERAL VIEWS OF THE DRAWINGS

These and other objects, advantages and features of the getter pump according to the present invention, as defined in claim 1, will be more evident from the following detailed description of a preferred embodiment thereof, reported by way of non-limiting examples with reference to the attached drawings, wherein:

FIG. 1*a* shows a sectional view of the steel housing or stub, intended to have inserted therein the getter pump according to the invention, which in FIG. 1*b* is represented, also in sectional view, in proximity of the structure of FIG. 1*a*;

FIG. 2 shows a sectional view of the assembled getter pump, corresponding to the assembly of FIGS. 1*a* and 1*b*;

DETAILED DESCRIPTION OF THE INVENTION

Figure 3:
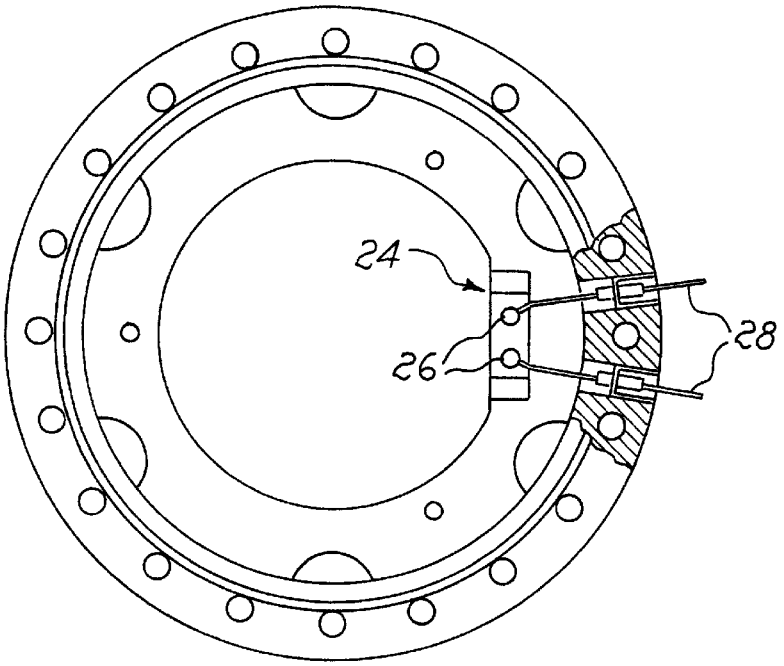
FIG. 3 shows a left side view of the assembly of FIG. 2.

With reference to the drawings, the getter pump according to the invention is formed of a substantially cylindrical cartridge 10 having two metal rings 12, 12*a* mutually parallel and arranged on the opposite ends of said cylinder, coaxial with respect to the pump and external with respect to its body, fastened to the inner wall of cartridge 10. Rings 12 have fastened thereto the opposite ends of the real getter device, formed of an elongated metal element coated with getter material, preferably zigzag- or coil-shaped, with bends 18 or turning zones corresponding to fixing and thermal insulation points 16 and 16*a* on rings 12 and 12*a*. Thus getter device 20 lies in a marginal area of cartridge 10 which has a substantially annulus configuration, wherein all the getter elements are arranged in proximity of the inner wall of cartridge 10, in order to minimize the reduction of conductance or passage area of the gas flow therethrough. It should be noted that, instead of a one-piece element zigzag or coil shaped, getter device 20 may be formed of a set of getter elements successively joined together at fixing points 16, 16*a* to rings 12, 12*a*. In both cases, the one-piece continuous getter element 20 or the different elements joined together in series to provide for the getter device are formed of a thread-like metallic core, preferably but not necessarily shaped as a coil spring having its axis coinciding with the trend resulting from the drawings. The getter material may be coated on said threadlike metallic core by inserting this latter inside a suitable mold, pouring into the mold powders of the desired getter material and sintering the powders inside the mold, e.g. by putting it into an oven. Many different getter materials may be used, generally comprising titanium and zirconium; their alloys with one or more elements selected among the transition metals and aluminium; and mixtures of one or more of these alloys and titanium and/or zirconium; the use of titanium and titanium-vanadium alloys is preferred. These materials are to be preferred owing to the powders being easily sintered and because getter elements produced by using these materials have good mechanical properties and practically no loss of particles, while maintaining porous properties such as to ensure excellent sorption capacity.

Figure 4:
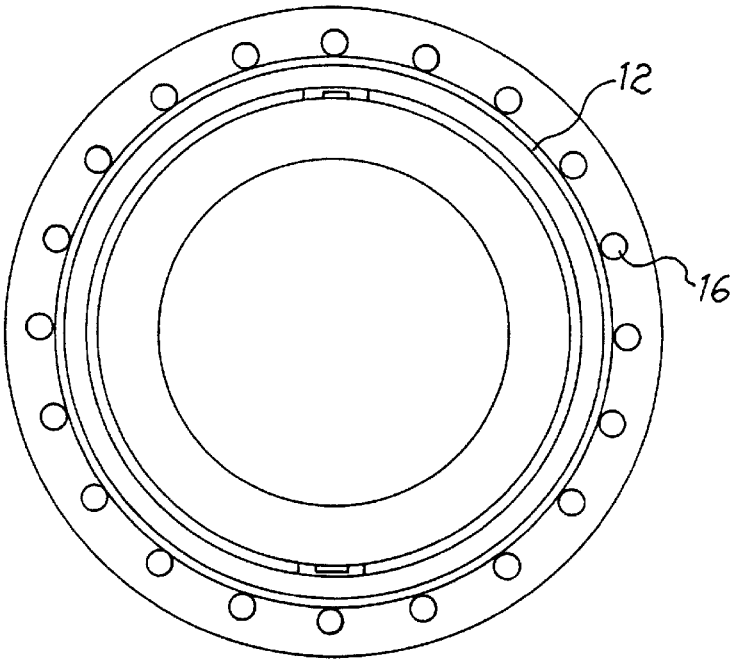
FIG. 4 shows a right side view of the same assembly.

Anyhow, both with getter device 20 formed of a one-piece continuous element having U-turns and with a plurality of different elements arranged in series, e.g. in a zigzag arrangement, getter device 20 has two ends 22 mutually contiguous and lying on the same side of cartridge 10, wherein the continuity of element 20 is interrupted. Ends 22 protrude mutually parallel from a side of cartridge 10, so as to be inserted in a supply box 24 in housing 30 or connecting "stub" between the chamber to be evacuated and the turbomolecular pump (not shown), which will be hereinafter described with reference to FIG. 1*a*. Said connecting stub 30 is formed of a cylinder made of stainless steel having a diameter slightly larger than the outer diameter of cartridge 10 and provided at its ends with two flanges 32 and 34 having through-holes. provided for fastening members such as screws and bolts. Box 24 is arranged such as far from flange 32, through which cartridge 10 is inserted, as to have, once the assembling is carried out, ends 22 inserted therein like plugs in a socket. On the opposite side, close to flange 34, box 24 has a pair of terminals 26, directed outwards having external supply conductors 28 connected thereto, as it is better seen in FIG. 4.

The getter pump according to the present invention, especially suitable for the use upstream and in proximity of turbomolecular pumps, is provided both with upstream and downstream valves (not shown), allowing to isolate said pump from the chamber to be evacuated, from the turbomolecular pump or from both of them, as sometimes necessary for moving, replacing or maintaining the getter pump.

For example, both the valves upstream and downstream of the getter pump are closed while moving the pump or mounting it in working position. It could be useful to have the upstream valve (towards the chamber to be evacuated) open and the valve towards the turbomolecular pump closed in case of maintenance operations on this latter or when in specific process steps it is enough to use the getter pump, although the system usually also requires the turbomolecular pump.

On the contrary, isolating the getter pump from the working chamber with the valve towards the turbomolecular pump open may be useful for the regeneration of the getter pump. In fact, this latter is especially useful for the hydrogen sorption, which is an equilibrium phenomenon; the hydrogen amount sorbed by a getter material increases upon decreasing of the temperature and upon increasing of the hydrogen partial pressure in the surrounding system Thus, by increasing the temperature of a getter which has sorbed a large hydrogen amount, and by working in pumping conditions, e.g. in this case by using a turbomolecular pump, it is possible to discharge the gas from the getter, thereby regenerating it.

However, the turbomolecular pumps may be damaged by an overheating when working at a too high gas pressure, which may occur during the getter pump regeneration. In order to prevent such a drawback, it is possible to slowly heat the getter element (or elements), such that also the hydrogen pressure slowly increases and that, considering the pumping rate of the turbomolecular pump, this does not reach critical pressures. Instead of this, the conductance between the getter pump and the turbomolecular pump may be reduced, by operating on the valve arranged therebetween.

It should be noted that, as aforementioned, the loss of particles from the getter material coated on element 20 is very small, owing to the product having been sintered in a high-temperature oven. Therefore, unlike the getter pumps of the prior art, the getter pump and the turbomolecular pump may be arranged in series.

Furthermore, as for the indirect measure of the temperature through the direct resistance measurement of the inner filament of element 20, it should be noted that since the inner filament supporting the getter material and the getter powder coated thereon are produced by controlled processes having a high reproducibility, a suitable curve R-T is obtained having an especially good tolerance. It is therefore possible to do without thermocouples in order to obtain the temperature values of the getter device.

Finally, since the getter pump is heated by direct passage of current in series, the heat absorption by the turbomolecular pump is very small in that it is only due to irradiation by the getter elements in a vacuum-environment, being much smaller than the irradiation by a lamp.

We claim:

1. A getter pump comprising a non-evaporable getter device (20) formed of an elongated thread-like metal element being coil- or zigzag-shaped and having coated thereon by sinterization a porous non-evaporable getter material, characterized in that said getter device (20) lies in an annulus-shaped peripheral zone of a cylindrical cartridge (10) coaxially assembled inside a steel cylindrical structure or stub (30) which is arranged between a working chamber to be evacuated and a turbomolecular pump, said getter device (20) being heated by direct supply of electric current to said thread-like metal element.

2. A getter pump according to claim 1, wherein said getter device (20) is formed of a one-piece continuous element extending between two contiguous ends (22) and forming with bends (18, 18*a*) or zigzag-turns a substantially cylindrical surface in proximity and coaxially with respect to the inner surface of said cartridge (10).

3. A getter pump according to claim 1, wherein said getter device (20) is formed of a sequence of elements in a zigzag arrangement, starting and ending in two contiguous points (22), thus forming a substantially cylindrical surface in proximity of the inner surface of said cartridge (10), being joined together at turning areas **(18, 18*a*)**.

4. A getter pump according to claim 2, wherein said bends or turning points **(18, 18*a*) are alternately fastened on opposite sides through fixing means (16, 16*a*) to respective flanges or rings (12, 12*a*), being assembled, mutually parallel, in proximity of the opposite bases of said cartridge (10)**.

5. A getter pump according to claim 2, wherein said end points (22) are separate and spaced mutually apart by a short distance on the same side of the cartridge (10), and are formed of two parallel plugs.

6. A getter pump according to claim 5, wherein inside said cylindrical stub (30) there is a supply box (24) with a socket for inserting said plugs (22) therethrough, once the cartridge (10) is assembled inside said stub, being provided with terminals (26) for fixing electric conductors connected with an external supply.

7. A getter pump according to claim 1, comprising isolating valves upstream, towards said working chamber to be evacuated, and downstream, towards said turbomolecular pump.

* * * * *